US010048605B1

(12) United States Patent
Sacripante et al.

(10) Patent No.: US 10,048,605 B1
(45) Date of Patent: Aug. 14, 2018

(54) COLD PRESSURE FIX TONER COMPRISING CRYSTALLINE RESIN AND HIGH AND LOW $T_g$ AMORPHOUS POLYESTER

(71) Applicant: XEROX CORPORATION, Norwalk, CT (US)

(72) Inventors: Guerino G. Sacripante, Oakville (CA); Yulin Wang, Oakville (CA); Nan-Xing Hu, Oakville (CA); Sandra J. Gardner, Oakville (CA); Richard Philip Nelson Veregin, Mississauga (CA)

(73) Assignee: XEROX CORPORATION, Norwalk, CT (US)

( * ) Notice: Subject to any disclaimer, the term of this patent is extended or adjusted under 35 U.S.C. 154(b) by 2 days.

(21) Appl. No.: 15/414,083

(22) Filed: Jan. 24, 2017

(51) Int. Cl.
*G03G 9/087* (2006.01)

(52) U.S. Cl.
CPC ..... *G03G 9/08755* (2013.01)

(58) Field of Classification Search
CPC ..... G03G 9/08755; G03G 9/08797
See application file for complete search history.

(56) References Cited

U.S. PATENT DOCUMENTS 4,935,324 A 6/1990 Grushkin et al.
5,013,630 A 5/1991 Ong et al.
5,023,159 A 6/1991 Ong et al.
5,231,135 A 7/1993 Machell et al.
5,283,153 A 2/1994 Sacripante et al.
5,621,022 A 4/1997 Jaeger et al.
6,221,137 B1 4/2001 King et al.
6,472,523 B1 10/2002 Banning et al.
6,476,219 B1 11/2002 Duff et al.
6,576,747 B1 6/2003 Carlini et al.
6,576,748 B1 6/2003 Carlini et al.
6,590,082 B1 7/2003 Banning et al.
6,646,111 B1 11/2003 Carlini et al.
(Continued)

OTHER PUBLICATIONS

Sugizaki, et al., "Technology Development of Spherical Polyester Toner by Suspension of Polymer/Pigment Solution and Solvent Removal Method," Journal of the Imaging Society of Japan, vol. 43, No. 1, 48-53, 2004.

*Primary Examiner* — Peter L Vajda
(74) *Attorney, Agent, or Firm* — Pillsbury Winthrop Shaw Pittman LLP

(57) ABSTRACT

Cold pressure fix toner compositions include at least one crystalline polyester having a melting point in a range from about 30° C. to about 130° C., a rosin acid-based polyester resin and an amorphous polyester having a $T_g$ higher than the rosin acid-based polyester. The crystalline polyester can have a melting point in a range from about 30° C. to about 130° C., the rosin acid-based polyester resin can have a $T_g$ in a range from about 0° C. to about −45° C. and an amorphous polyester having a $T_g$ in a range from about 40° C. to about 70° C. The temperature difference between the rosin acid-based polyester resin and the amorphous polyester resin can be in a range from about 30° C. to about 110° C.

17 Claims, 1 Drawing Sheet

(SAMPLE 1) (SAMPLE 2)

(56) References Cited

U.S. PATENT DOCUMENTS

| | | | | |
|---|---|---|---|---|
| 6,663,703 | B1 | 12/2003 | Wu et al. | |
| 6,673,139 | B1 | 1/2004 | Wu et al. | |
| 6,696,552 | B2 | 2/2004 | Mayo et al. | |
| 6,713,614 | B2 | 3/2004 | Carlini et al. | |
| 6,726,755 | B2 | 4/2004 | Titterington et al. | |
| 6,755,902 | B2 | 6/2004 | Banning et al. | |
| 6,821,327 | B2 | 11/2004 | Jaeger et al. | |
| 6,958,406 | B2 | 10/2005 | Banning et al. | |
| 7,053,227 | B2 | 5/2006 | Jaeger et al. | |
| 7,381,831 | B1 | 6/2008 | Banning et al. | |
| 7,427,323 | B1 | 9/2008 | Birau et al. | |
| 8,273,516 | B2 | 9/2012 | Wosnick et al. | |
| 8,541,153 | B2 | 9/2013 | Matsumura et al. | |
| 2011/0033793 | A1* | 2/2011 | Chen ..... | G03G 9/0804<br>430/105 |

* cited by examiner (SAMPLE 1)

(SAMPLE 2)

COLD PRESSURE FIX TONER COMPRISING CRYSTALLINE RESIN AND HIGH AND LOW $T_g$ AMORPHOUS POLYESTER

BACKGROUND

The present disclosure relates to toner compositions for use in xerography. In particular, the present disclosure relates to cold pressure fix toner compositions.

Cold pressure fix toners normally operate in a system employing a pair of high-pressure rollers to fix toner to paper without heating. Among the advantages of such systems are the use of low power and little paper heating. One example of a cold pressure fix toner comprises predominantly wax an ethylene-vinyl acetate copolymer with softening point of 99° C., and a 120° C. softening point polyamide thermoplastic polymer. An example of this approach is shown in U.S. Pat. No. 4,935,324, which is incorporated herein by reference. Another example of a cold pressure fix toner is comprised of a copolymer of styrene with 1-tertiary-butyl-2-ethenyl benzene and a polyolefin wax exemplified for example as Xerox 4060 cold pressure fix toner. Other cold fix toners have been based on a long chain acrylate core produced by suspension polymerization, such as lauryl acrylate. Examples of such compositions are disclosed in U.S. Pat. Nos. 5,013,630 and 5,023,159 which are incorporated herein by reference. Such systems are designed to have a core with a $T_g$ less than room temperature. A hard shell, such as polyurethane prepared by an interfacial polymerization, is disposed about the core in order to keep the liquid content in the core in the toner particle.

Performance issues in designs with high wax content include that they work only at high pressure, such as about 2000 psi or even 4000 psi, which are respectively, 140 kgf/cm$^2$ and 280 kgf/cm$^2$ and even then image robustness can be poor. In the case of long chain acrylate core designs the shell needs to be very thin to break under pressure, but it can be very challenging to prevent the capsules from leaking because the core is typically a liquid at room temperature.

Other material approaches for CPF toners include baroplastics materials comprising nanophase polymeric materials comprised of two components that can become miscible with each other under pressure thereby facilitating flow. Block copolymers have been employed as disclosed in U.S. Pat. No. 8,273,516, wherein the baroplastic resin comprises of a low $T_g$ and a high $T_g$ component that nanophase separate. CPF toners have been prepared based on mixing a crystalline polyester resin and small molecule rosinated ester together with or without an amorphous resin to provide a material that undergoes a phase change from solid to liquid with pressure. Although good fixing properties were obtained, the CPF toners resulted in poor pen-offset, blocking and low charging/electrical performance. CPF toners prepared to date provide modest cold pressure fix performance, and thus there is a continuing need for new CPF toners.

SUMMARY

In some aspects, embodiments herein relate to cold pressure fix toner compositions comprising at least one crystalline polyester having a melting point in a range from about 30° C. to about 130° C. and a rosin acid-based polyester resin, and an amorphous polyester having a $T_g$ higher than the rosin acid-based polyester.

In some aspects, embodiments herein relate to cold pressure fix toner compositions comprising at least one crystalline polyester having a melting point in a range from about 30° C. to about 130° C., and a rosin acid-based polyester resin having a $T_g$ in a range from about 0° C. to about −45° C., and an amorphous polyester having a $T_g$ in a range from about 40° C. to about 70° C.

In some aspects, embodiments herein relate to cold pressure fix toner composition comprising at least one crystalline polyester having a melting point in a range from about 30° C. to about 130° C., and a rosin acid-based polyester resin, and an amorphous polyester having a $T_g$ higher than the rosin acid-based polyester, wherein the temperature difference between the rosin acid-based polyester resin and the amorphous polyester resin is in a range from about 30° C. to about 110° C.

BRIEF DESCRIPTION OF DRAWINGS

Various embodiments of the present disclosure will be described herein below with reference to the figures wherein.

DETAILED DESCRIPTION

Figure 1A:
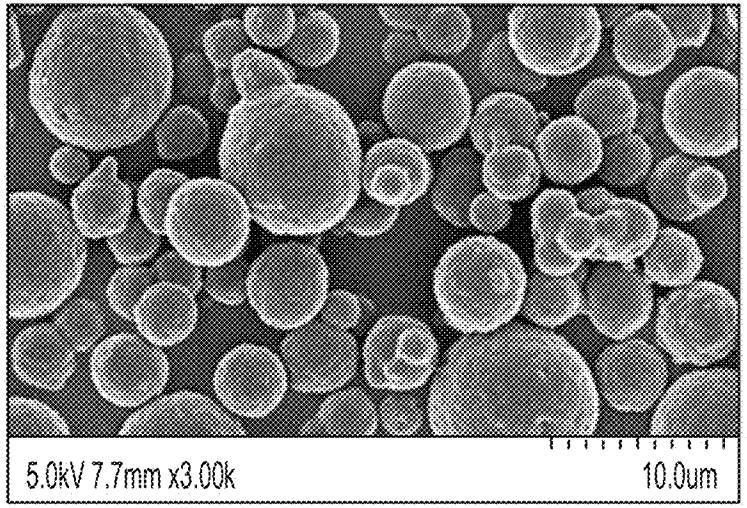
FIG. 1A shows a scanning electron micrograph (SEM) image of CPF toner particles prepared in accordance with embodiments herein.
Figure 1B:
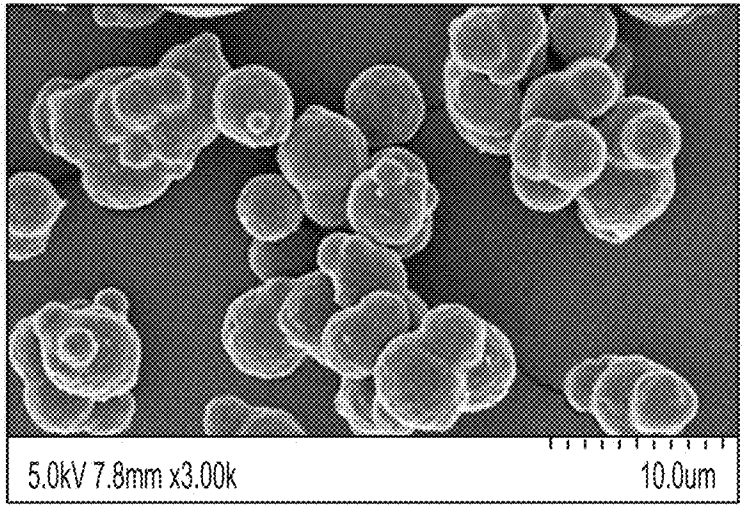
FIG. 1B shows a scanning electron micrograph (SEM) image of CPF toner particles prepared in accordance with embodiments herein.

Embodiments herein provide CPF toners comprising a crystalline resin and both a low $T_g$ polyester resin and a high $T_g$ amorphous polyester resin formulated to provide cold pressure fixing properties. In order to improve CPF toner performance while retaining good fix properties, embodiments herein employ a rosin acid-based polyester resins with low $T_g$, and encapsulate the toner with an amorphous polyester or amorphous styrene-acrylate shell.

In embodiments, there are provided cold pressure fix toner compositions comprising at least one crystalline polyester having a melting point in a range from about 30° C. to about 130° C. and a rosin acid-based polyester resin, and an amorphous polyester having a $T_g$ higher than the rosin acid-based polyester.

In embodiments, the at least one crystalline polyester comprises a diester.

In embodiments, the number average molecular weight $M_n$ of the crystalline polyester is from about 300 to about 1200, and a weight average molecular weight $M_w$ is from about 300 to about 2,000.

In embodiments, the rosin acid-based polyester resin is formula I:

I

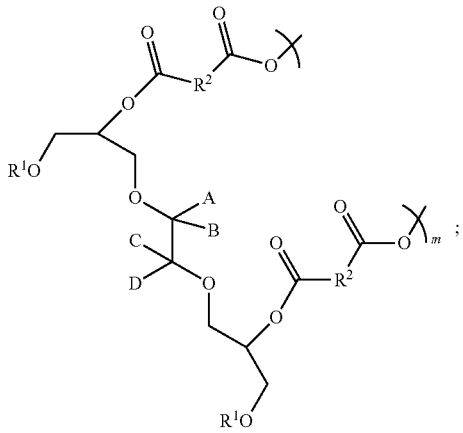

wherein $R^1$ is a rosin acid of an abietic acid, a pimaric acid, or combinations thereof;

$R^2$ is $(CH_2)_n$, wherein n is an integer from 2 to 8;

A, B, C, and D are independently hydrogen or methyl; and m is an integer from 10 to 10,000.

In embodiments, the number average molecular weight $M_n$ of the amorphous polyester is from about 3,000 to about 120,000, and the weight average molecular weight $M_w$ is from about 5,000 to about 200,000 grams per mole.

In embodiments, the temperature difference between the rosin acid-based polyester resin and the amorphous polyester resin is in a range from about 30° C. to about 110° C. In embodiments, the temperature difference between the rosin acid-based polyester resin and the amorphous polyester resin is in a range from about 20° C. to about 50° C.

In embodiments, the rosin acid-based polyester resin has a $T_g$ in a range from about 0° C. to about −45° C.

In embodiments, the amorphous polyester resin has a $T_g$ in a range from about 40° C. to about 70° C.

In embodiments, there are provided cold pressure fix toner compositions comprising at least one crystalline polyester having a melting point in a range from about 30° C. to about 130° C., and a rosin acid-based polyester resin having a $T_g$ in a range from about 0° C. to about −45° C., and an amorphous polyester having a $T_g$ in a range from about 40° C. to about 70° C.

In embodiments, the at least one crystalline polyester comprises a diester.

In embodiments, the number average molecular weight $M_n$ of the crystalline polyester is from about 300 to about 1200, and a weight average molecular weight $M_w$ is from about 300 to about 2,000.

In embodiments, the rosin acid-based polyester resin is formula I:

I

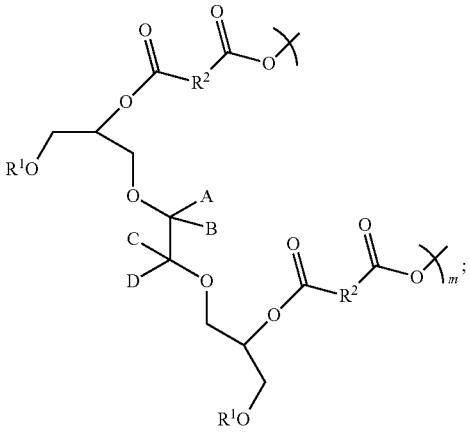

wherein $R^1$ is a rosin acid of a family member of an abietic acid and/or a pimaric acid, wherein the family member of the abietic acid and/or pimaric acid is selected from the group consisting of dehydro-abietic acid, neo-abietic acid, levo-pimaric acid, pimaric acid, sandaracopimaric acid, iso-pimaric acid and tetrahydro abietic acid, $R^2$ is $(CH_2)_n$, wherein n is an integer from 2 to 8;

A, B, C, and D are independently hydrogen or methyl; and m is an integer from 10 to 10,000.

In embodiments, the number average molecular weight $M_n$ of the amorphous polyester is from about 300 to about 1200, and the weight average molecular weight Mw is from about 300 to about 2,000.

In embodiments, the temperature difference between the rosin acid-based polyester resin and the amorphous polyester resin is in a range from about 30° C. to about 110° C.

In embodiments, the temperature difference between the rosin acid-based polyester resin and the amorphous polyester resin is in a range from about 20° C. to about 50° C.

In embodiments, there are provided cold pressure fix toner compositions comprising at least one crystalline polyester having a melting point in a range from about 30° C. to about 130° C., and a rosin acid-based polyester resin, and an amorphous polyester having a $T_g$ higher than the rosin acid-based polyester, wherein the temperature difference between the rosin acid-based polyester resin and the amorphous polyester resin is in a range from about 30° C. to about 110° C.

In embodiments, the at least one crystalline polyester comprises a diester.

In embodiments, the number average molecular weight $M_n$ of the crystalline polyester is from about 300 to about 1200, and a weight average molecular weight $M_w$ is from about 300 to about 2,000.

In embodiments, the rosin acid-based polyester resin is formula I:

I

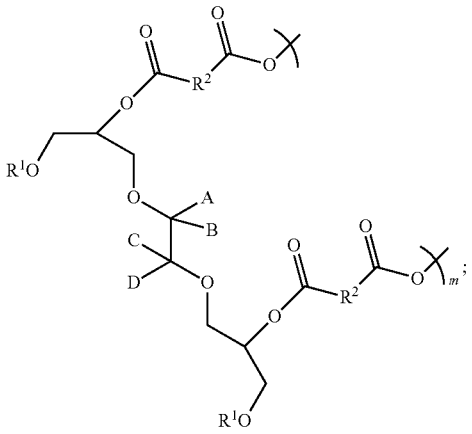

wherein $R^1$ is a rosin acid of a family member of an abietic acid and/or a pimaric acid, wherein the family member of the abietic acid and/or pimaric acid is selected from the group consisting of dehydro-abietic acid, neo-abietic acid, levo-pimaric acid, pimaric acid, sandaracopimaric acid, iso-pimaric acid and tetrahydro abietic acid;

$R^2$ is $(CH_2)_n$, wherein n is an integer from 2 to 8;

A, B, C, and D are independently hydrogen or methyl; and m is an integer from 10 to 10,000.

In embodiments, rosin acid-based polyester resins with low $T_g$ are amorphous and may be obtained by reacting a commercial rosin acid product (which may comprise compounds of formula general formula $C_{19}H_{29}COOH$ and exemplified by the family of abietic and/or pimaric acids, any of which are optionally hydrogenated, and mixtures thereof derived from tree resins) with a glycol diglycidyl ether to afford a rosin-diol which is then polymerized with aliphatic diacids to provide rosin acid-based polyester resins (I) with low $T_g$ as indicated below in Scheme 1:

Scheme I

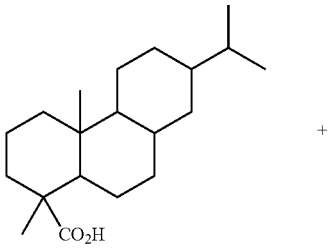

Generic Rosin acid = $R^1$

Note: actual rosin acids contain unsaturations at various positions.

-continued

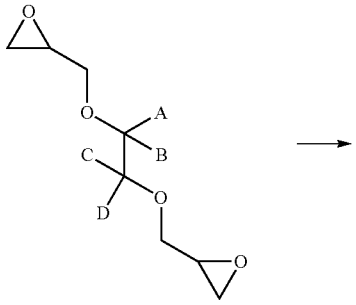

A, B, C, D are independently H or methyl

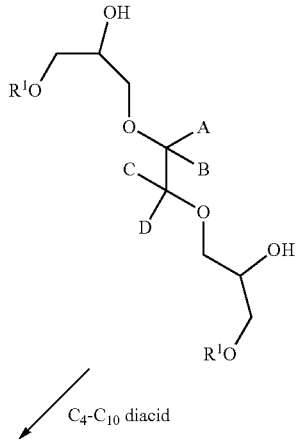

$C_4$-$C_{10}$ diacid

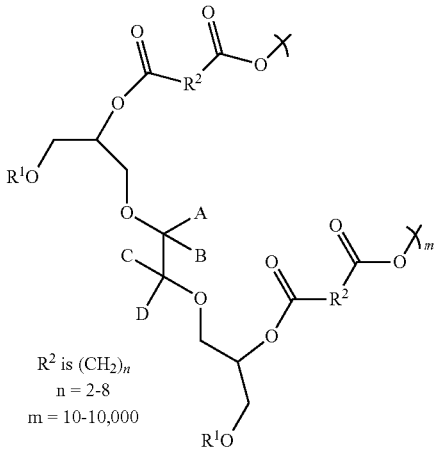

$R^2$ is $(CH_2)_n$
n = 2-8
m = 10-10,000

(I)

In embodiments, in compounds of formula (I) m is an integer from 10 to 10,000, or 10 to 5,000, or 10 to 1,000, or 10 to 500, or 10 to 100, including any range or sub-range in between. In other embodiments, m is an integer from 100 to 10,000, or 500 to 10,000, or 1,000 to 10,000, or 5,000 to 10,000, including any range or sub-range in between.

Depending on the length of the aliphatic diacid component, very low to low $T_g$ resin can be obtained as demonstrated in Table 1 below.

TABLE 1

| Resin | Diacid ($R_2$) | Viscosity poise | A.V. mg KOH/g | $T_g$ ° C. | $M_n$ Kg/mole | $M_w$ Kg/ mole |
|---|---|---|---|---|---|---|
| 1. A/B = Me C/D = H | Sebacic; R=$(CH_2)_8$ | 15 | 13.5 | −43.8 | 4.8 | 17.3 |
| 2. A/B = Me C/D = H | Succinic; $R_2$=$(CH_2)_2$ | 61.8 | 12.8 | −6.5 | 3.7 | 15.7 |

The rosin acid-based polyester resins may use a diacid component having from 3 to 20 carbons, or 3 to 14 carbons, or 4 to 10 carbons. In embodiments, the glycol diglycidyl ether is based on 1,1-dimethyl ethylene glycol.

As used herein, "cold pressure fix toner" or "CPF toner" refers to a toner material designed for application to a substrate and which is affixed to the substrate primarily by application of pressure. While heating may be optionally employed to assist in fixing a CPF toner, one benefit of the compositions disclosed herein is the ability to used reduced heating, or in embodiments, no applied heating. Affixing by application of pressure may be achieved in a broad range of pressures, such as from about 50 kgf/cm$^2$ to about 100 kgf/cm$^2$ to about 200 kgf/cm$^2$. If necessary it is possible to use higher pressures up to about 400 kgf/cm$^2$, however, generally such higher pressures are undesirable, causing calendaring and even wrinkling of the paper which distorts the look and feel of the paper, and requires more robust pressure fix rolls and spring assemblies.

In embodiments, the CPF toner comprises at least one crystalline polyester. In some such embodiments, the CPF toner comprises a crystalline diester. In embodiments, the at least one crystalline ester comprises an optionally substituted phenyl or benzyl ester. In embodiments, the at least one crystalline ester comprises distearyl terephthalate (DST).

In embodiments, suitable crystalline esters may be diesters from about $C_{16}$ to $C_{80}$, with melting points in a range from about 30° C. to about 130° C., such as those shown in the examples below in Table 2.

In embodiments, it may be desirable to incorporate one or more acid groups, such as carboxylate or sulfonate, in these materials to provide negative charge to enhance toner performance. These acid groups may also be useful so the materials may be employed in the emulsion/aggregation toner processing. In embodiments, the acid moiety may be disposed in any position on the aromatic residues of the compounds in Table 2. In other embodiments, the acid may be provided by including some amount of monoester in place of the diester so that one end of the molecule bears an acid moiety.

TABLE 2

| Structure | $T_{melt}$ (° C.) | $T_{crys}$ (° C.) | $T_g$ (° C.) |
|---|---|---|---|
| 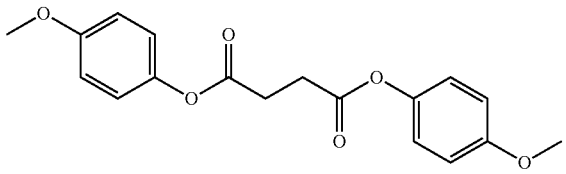 | 94 | 47 | n/a |
| 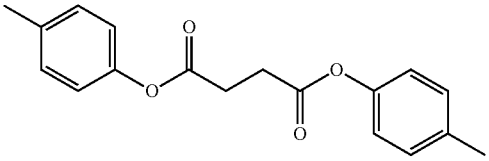 | 115 | 62 | n/a |
| 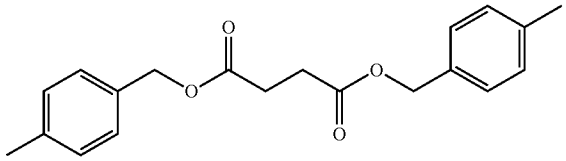 | 74 | ~50 | n/a |
| 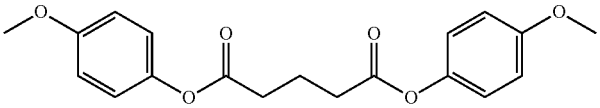 | 102 | 51 | n/a |
| 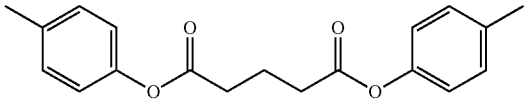 | 86 | 34 | n/a |

TABLE 2-continued
| Structure | $T_{melt}$ (° C.) | $T_{crys}$ (° C.) | $T_g$ (° C.) |
|---|---|---|---|
| 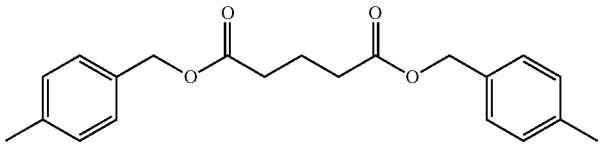 | 35 | n/a | n/a |
| 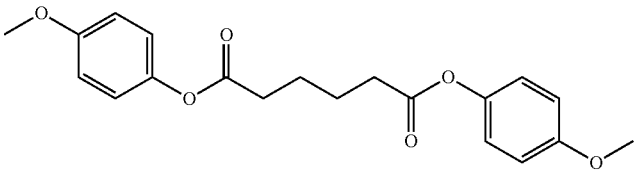 | 127 | 75 | n/a |
| 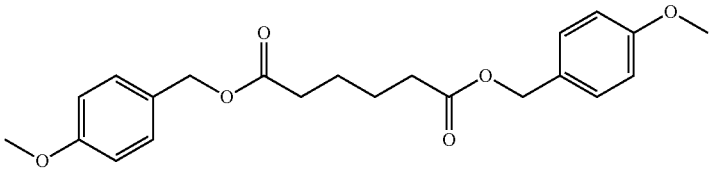 | 59 | 20-26 | n/a |
| 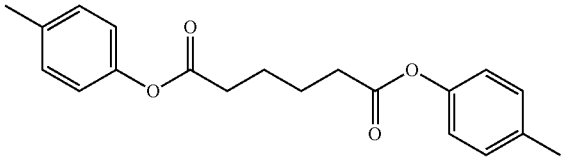 | 100 | 62 | n/a |
| 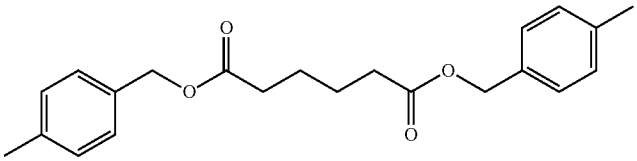 | 56 | −5 | n/a |
| 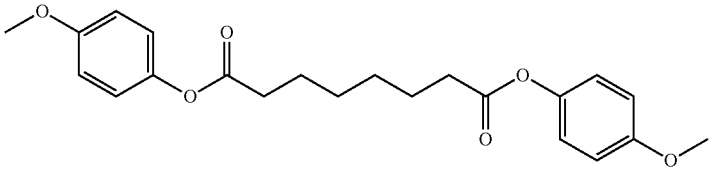 | 119 | ~75 | n/a |
| 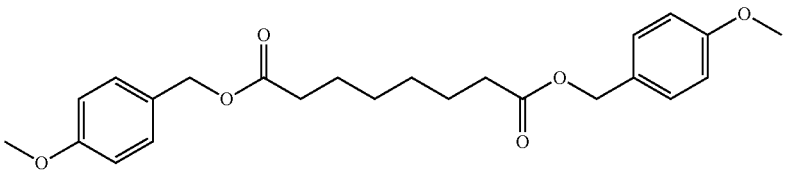 | 80 | 18 | n/a |
| 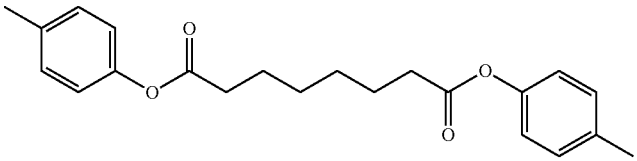 | 80, 83 | 63 | n/a |
| 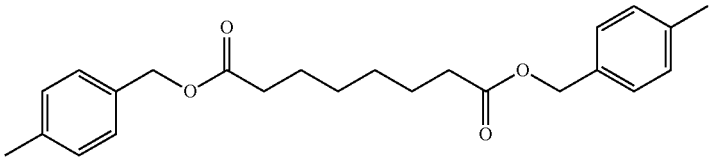 | 71 | 21 | n/a |

TABLE 2-continued

| Structure | $T_{melt}$ (° C.) | $T_{crys}$ (° C.) | $T_g$ (° C.) |
|---|---|---|---|
| 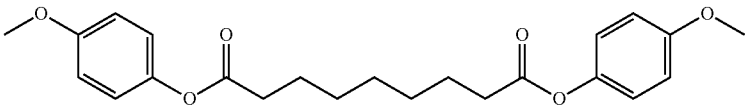 | 87 | ~50 | n/a |
| 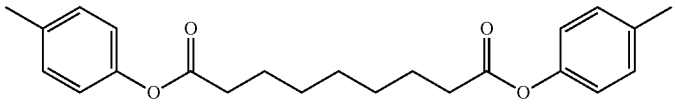 | 69 | 42 | n/a |
| 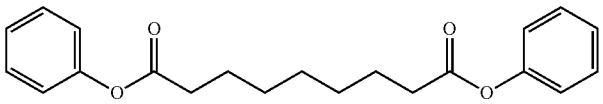 | 58 | 3 | n/a |
| 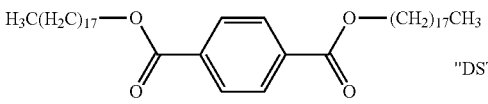 "DST" | 88 | 79 | n/a |
| 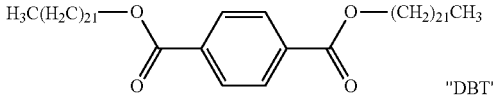 "DBT" | 95 | 82 | n/a |
| 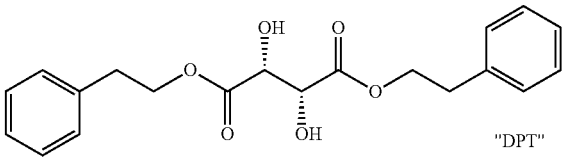 "DPT" | 110 | 83 | n/a |

In embodiments, the crystalline compound is a di-ester compounds made from Scheme 2 below.

Scheme 2

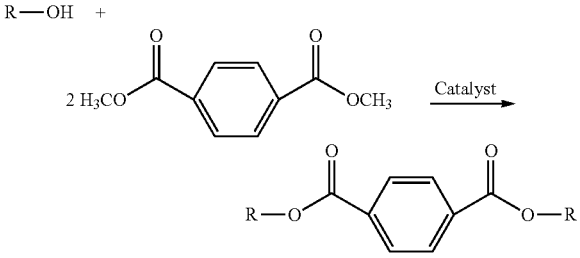

In embodiments, R is a saturated or ethylenically unsaturated aliphatic group in one embodiment with at least about 6 carbon atoms, and in another embodiment with at least about 8 carbon atoms, and in one embodiment with no more than about 100 carbon atoms, in another embodiment with no more than about 80 carbon atoms, and in yet another embodiment with no more than about 60 carbon atoms, although the number of carbon atoms can be outside of these ranges, In a specific embodiment, the crystalline compound is derived from natural fatty alcohols such as octanol, stearyl alcohol, lauryl alcohol, behenyl alcohol, myristyl alcohol, capric alcohol, linoleyl alcohol, and the like. The above reaction may be conducted by combining dimethyl terepthalate and alcohol in the melt in the presence of a tin catalyst, such as, dibutyl tin dilaurate (Fascat 4202), dibutyl tin oxide (Fascat 4100); a zinc catalyst, such as Bi cat Z; or a bismuth catalyst, such as Bi cat 8124; Bi cat 8108, a titanium catalyst such as titanium dioxide Only trace quantities of catalyst are required for the process.

In embodiments, the catalyst is present in an amount of about 0.01 weight percent to 2 weight percent or of about 0.05 weight percent to about 1 weight percent of the total product.

The reaction can be carried out at an elevated temperature of about 150° C. to about 250° C. or from about 160° C. to about 210° C. The solvent-free process is environmentally sustainable and eliminates problems with byproducts and also means higher reactor throughput.

In embodiments, the crystalline component may have a structure of Formula A:

A

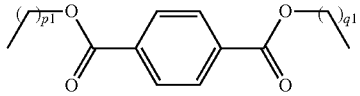

wherein p1 is from about 1 to about 40, and q1 is from about 1 to about 40. In certain embodiments, p1 is from about 8 to about 26, from about 14 to about 20, or from about 16 to about 18. In certain embodiments, q1 is from about 8 to about 26, from about 14 to about 20, or from about 16 to about 18. In certain embodiments, p1 is the same as q1.

In embodiments, the crystalline component is present in an amount of from about 50 percent to about 95 percent by weight, from about 60 percent to about 95 percent by weight, or from about 65 percent to about 95 percent by weight, or from about 70 percent to about 90 percent by weight of the total weight of the CPF toner composition.

Typically, the weight ratio of the crystalline component to the amorphous component is from about 50:50 to about 95:5, or is from about 60:40 to about 95:5, or is from about 70:30 to about 90:10.

In embodiments, the crystalline component is a polyester resin. Crystalline polyester resins can be prepared from a diacid and a diol. Examples of organic diols selected for the preparation of crystalline polyester resins include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, and the like.

Examples of organic diacids or diesters selected for the preparation of the crystalline polyester resins include oxalic acid, succinic acid, glutaric acid, adipic acid, suberic acid, azelaic acid, sebacic acid, dodecanedioic acid, phthalic acid, isophthalic acid, terephthalic acid, napthalene-2,6-dicarboxylic acid, naphthalene-2,7-dicarboxylic acid, cyclohexane dicarboxylic acid, malonic acid and mesaconic acid, a diester or anhydride thereof. The organic diacid may be selected in an amount of, for example, from about 40 to about 50 mole percent of the resin.

As an example, crystalline resins, 1,12-dodecanedioic acid has been prepared with diols from C3 (1,3-propylene glycol), to C12, (1,12-dodecanediol), to yield crystalline polyesters with a Tm from about 60° C. to about 90° C. The properties of crystalline polyesters used in connection with embodiments herein are shown in Table 3 below.

TABLE 3

| | | AV | Tm (° C.) | GPC (kg/mole) | |
|---|---|---|---|---|---|
| Resin ID | Acid:Diol | Mg KOH/g | 1st | Mw | Mn |
| A | C12:C9 | 10.3 | 71.0 | 24.2 | 6.8 |
| B | C12:C6 | 14.5 | 72.3 | 14.3 | 6.1 |
| C | C12:C3 | 17 | 66.1 | 13.4 | 6.6 |

In embodiments the temperature for the viscosity of the material to be reduced to a value of about 10,000 Pa-s at about 100 kgf/cm$^2$ applied pressure, is from about 0° C. to about 50° C., in other embodiments about 10° C. to about 40° C., in further embodiments from about 0° C. to about 30° C. In other embodiments the applied pressure for toner materials flow is from about 25 to about 400 kgf/cm$^2$, and in further embodiments from about 50 to about 200 kgf/cm$^2$. For cold pressure fixable toner it may be desirable to have the toner material flow near room temperature under the applied pressure of the cold pressure fixing system, to enable the toner to flow over the substrate surface and into pores or fibers in the substrate, as well as to enable the toner particles to flow into each other, thus providing a smooth continuous toner layer that is effectively adhered to the substrate. It may be desirable that the pressure applied be relatively low compared to the prior art, such as about 100 kgf/cm$^2$. However, in embodiments the pressure can be higher, up to about 400 kgf/cm$^2$, or lower, as little as 25 kgf/cm$^2$, provided that the above described conditions for onset of toner flow and flow viscosity can be met. In embodiments, some heat may be applied to preheat the toner or the paper prior to entry to the cold pressure fixing system, which can enable cold pressure fix for temperatures somewhat above room temperature.

In embodiments, it may be desirable for cold pressure fix that under low pressures, such as about 10 kgf/cm$^2$ applied pressure the cold pressure fix toner does not flow significantly such that the toner particles stick together, for example in the toner cartridge, or in the printer, including in the developer housing, or on the imaging surfaces such as the photoreceptor, or in embodiments the intermediate transfer belt. In shipping or in the printer the temperature may rise to as much as 50° C., thus in embodiments it may be desirable that the toner does not flow significantly to allow the particles stick together up to 50° C. at about 10 kgf/cm$^2$. Thus, in embodiments the temperature for the viscosity of the material to be reduced to a value of about 10,000 Pa-s, for the cold pressure fix toner at a lower pressure of about 10 kgf/cm$^2$ applied pressure, is from about 50° C. to about 70° C., in embodiments about 55° C. to about 70° C., in embodiments about 60° C. to about 90° C., or in further embodiments at about 20 kgf/cm$^2$ to about 40 kgf/cm$^2$.

Thus, it may be desirable to have a high temperature for material flow at low pressures representative of storage and usage in the printer, and a low temperature for material at the desired higher cold pressure fix pressure. In embodiments there is a temperature shift calculated in the range from about 10° C. to about 60° C. where the flow viscosity of the cold pressure fix composition equal to about 10,000 pascal-seconds, when the applied pressure on the cold pressure fix composition is increased from 10 to 100 Kgf/cm$^2$. In such embodiments, the temperature shift can be calculated as, $$\Delta T_{\eta=10000} = T_{\eta=10000}(10\ \text{kgf/cm}^2) - T_{\eta=10000}(100\ \text{kgf/cm}^2)$$

where $T_{\eta=10000}$ (10 kgf/cm$^2$) is the temperature for flow viscosity $\eta$ of 10000 Pa-s at 10 kgf/cm$^2$ applied pressure and $T_{\eta=10000}$ (100 kgf/cm$^2$) is the temperature for flow viscosity $\eta$ of 10000 Pa-s at 100 kgf/cm$^2$. In other embodiments the low pressure for storage and printer usage applied can be in the range of about 10 kgf/cm$^2$ to about 40 kgf/cm$^2$, and the high pressure for applied for cold pressure fix can be in the range of about 25 kgf/cm$^2$ to about 400 kgf/cm$^2$.

In embodiments, there are provided methods of cold pressure fix toner application comprising providing a cold pressure fix toner composition comprising: at least one crystalline material and a rosin-based polyester resin as described herein above and a second polyester resin having a higher $T_g$ than the rosin-based polyester resin, disposing the cold pressure fix toner composition on a substrate, and applying pressure to the disposed composition on the substrate under cold pressure fixing conditions. In some embodiments, the applied pressure is in a range from about 25 kgf/cm$^2$ to about 400 kgf/cm$^2$. In embodiments, cold pressure fix is accomplished by applying pressure in the aforementioned range between two fixing rolls that may be selected from known fixing rolls, such as in U.S. Pat. No. 8,541,153 herein incorporated by reference. Examples of the fixing rolls are cylindrical metal rolls, which optionally may be coated with fluorine containing resins such as TEFLON® PTFE polytetrafluoroethylene resins, TEFLON® PFA perfluoroalkoxy resins, TEFLON® FEP a fluorinated ethylene propylene, DUPONT™ TEFLON® AF amorphous fluoroplastic resins, and silicon resins, or a combination of the different resins. The two fixing rolls may be made of the same materials or may be different. In embodiments the fixing step is cold pressure fix without any direct application of heat in the fixing step. However, due to the heat from the printer components, frictional heating between the rolls, the temperature may be elevated above room temperature in the fusing nip. In addition, the paper and or toner layer on the paper in embodiments may be heated for example with a heat lamp prior to the cold pressure fix apparatus.

In embodiments, there are provided latexes formed from a cold pressure fix toner compositions. Toners can be prepared from the cold press toner compositions disclosed herein by any means, including conventional extrusion and grinding, suspension, SPSS (Spherical Polyester Toner by Suspension of Polymer/Pigment Solution and Solvent Removal Method., as described in Journal of the Imaging Society of Japan, Vol. 43, 1, 48-53, 2004), incorporated in an N-Cap toner, (encapsulated toner, as described for example in U.S. Pat. No. 5,283,153 and incorporated in an emulsion aggregation toner, optionally with a shell. Where needed for toner applications, latexes can be made incorporating the crystalline and/or amorphous mixtures, prepared by solvent flash, by phase inversion emulsification, including by solvent free methods.

Other additives may be present in the CPF toners disclosed here. The CPF toner compositions of the present embodiments may further optionally include one or more conventional additives to take advantage of the known functionality associated with such conventional additives. Such additives may include, for example, colorants, antioxidants, defoamer, slip and leveling agents, clarifier, viscosity modifier, adhesive, plasticizer and the like. When present, the optional additives may each, or in combination, be present in the CPF toner in any desired or effective amount, such as from about 1% to about 10%, from about 5% to about 10%, or from about 3% to about 5% by weight of the CPF toner.

In a typical CPF toner composition antioxidants are added for preventing discoloration of the small molecule composition. In embodiments, the antioxidant material can include IRGANOX® 1010; and NAUGARD® 76, NAUGARD® 445, NAUGARD® 512, and NAUGARD® 524. In embodiments, the antioxidant is NAUGARD® 445. In other embodiments the antioxidant material can include MAYZO® BNX® 1425 a calcium salt of phosphonic acid, and MAYZO® BNX® 358 a thiophenol both available commercially from MAYZO®, and ETHANOX® 323A a nonylphenol disulfide available commercially from SI Group.

In embodiments, CPF toners disclosed herein may further comprise a plasticizer. Exemplary plasticizers may include Uniplex 250 (commercially available from Unitex), the phthalate ester plasticizers commercially available from Ferro under the trade name SANTICIZER®, such as dioctyl phthalate, diundecyl phthalate, alkylbenzyl phthalate (SANTICIZER® 278), triphenyl phosphate (commercially available from Ferro), KP-140, a tributoxyethyl phosphate (commercially available from Great Lakes Chemical Corporation), MORFLEX® 150, a dicyclohexyl phthalate (commercially available from Morflex Chemical Company Inc.), trioctyl trimellitate (commercially available from Sigma Aldrich Co.), and the like. Plasticizers may be present in an amount from about 0.01 to about 30 percent, from about 0.1 to about 25 percent, from about 1 to about 20 percent by weight of the CPF toner.

In embodiments, the cold pressure fix toner compositions described herein also include a colorant. Any desired or effective colorant can be employed in the cold pressure fix toner compositions, including dyes, pigments, mixtures thereof. Any dye or pigment may be chosen, provided that it is capable of being dispersed or dissolved in the CPF toner and is compatible with the other CPF toner components. Any conventional cold pressure fix toner colorant materials, such as Color Index (C.I.) Solvent Dyes, Disperse Dyes, modified Acid and Direct Dyes, Basic Dyes, Sulphur Dyes, Vat Dyes, fluorescent dyes and the like. Examples of suitable dyes include NEOZAPON® Red 492 (BASF); ORASOL® Red G (Pylam Products); Direct Brilliant Pink B (Oriental Giant Dyes); Direct Red 3BL (Classic Dyestuffs); SUPRANOL® Brilliant Red 3BW (Bayer AG); Lemon Yellow 6G (United Chemie); Light Fast Yellow 3G (Shaanxi); Aizen Spilon Yellow C-GNH (Hodogaya Chemical); Bemachrome Yellow GD Sub (Classic Dyestuffs); CARTASOL® Brilliant Yellow 4GF (Clariant); Cibanone Yellow 2G (Classic Dyestuffs); ORASOL® Black RLI (BASF); ORASOL® Black CN (Pylam Products); Savinyl Black RLSN (Clariant); Pyrazol Black BG (Clariant); MORFAST® Black 101 (Rohm & Haas); Diaazol Black RN (ICI); THERMOPLAST® Blue 670 (BASF); ORASOL® Blue GN (Pylam Products); Savinyl Blue GLS (Clariant); LUXOL® Fast Blue MBSN (Pylam Products); Sevron Blue 5GMF (Classic Dyestuffs); BASACID® Blue 750 (BASF); KEYPLAST® Blue (Keystone Aniline Corporation); NEOZAPON® Black X51 (BASF); Classic Solvent Black 7 (Classic Dyestuffs); SUDAN® Blue 670 (C.I. 61554) (BASF); SUDAN® Yellow 146 (C.I. 12700) (BASF); SUDAN® Red 462 (C.I. 26050) (BASF); C.I. Disperse Yellow 238; Neptune Red Base NB543 (BASF, C.I. Solvent Red 49); Neopen Blue FF-4012 (BASF); Fatsol Black BR (C.I. Solvent Black 35) (Chemische Fabriek Triade BV); Morton Morplas Magenta 36 (C.I. Solvent Red 172); metal phthalocyanine colorants such as those disclosed in U.S. Pat. No. 6,221,137, the disclosure of which is totally incorporated herein by reference, and the like. Polymeric dyes can also be used, such as those disclosed in, for example, U.S. Pat. No. 5,621,022 and U.S. Pat. No. 5,231,135, the disclosures of each of which are herein entirely incorporated herein by reference, and commercially available from, for example, Milliken & Company as Milliken Ink Yellow 869, Milliken Ink Blue 92, Milliken Ink Red 357, Milliken Ink Yellow 1800, Milliken Ink Black 8915-67, uncut Reactint Orange X-38, uncut Reactint Blue X-17, Solvent Yellow 162, Acid Red 52, Solvent Blue 44, and uncut Reactint Violet X-80.

Pigments are also suitable colorants for the cold pressure fix toners. Examples of suitable pigments include PALIOGEN® Violet 5100 (BASF); PALIOGEN® Violet 5890 (BASF); HELIOGEN® Green L8730 (BASF); LITHOL® Scarlet D3700 (BASE); SUNFAST® Blue 15:4 (Sun Chemical); HOSTAPERM® Blue B2G-D (Clariant); HOSTAPERM® Blue B4G (Clariant); Permanent Red P-F7RK; HOSTAPERM® Violet BL (Clariant); LITHOL® Scarlet 4440 (BASF); Bon Red C (Dominion Color Company); ORACET® Pink RF (BASF); PALIOGEN® Red 3871 K (BASF); SUNFAST® Blue 15:3 (Sun Chemical); PALIOGEN® Red 3340 (BASF); SUNFAST® Carbazole Violet 23 (Sun Chemical); LITHOL® Fast Scarlet L4300 (BASF); SUNBRITE® Yellow 17 (Sun Chemical); HELIOGEN® Blue L6900, L7020 (BASF); SUNBRITE® Yellow 74 (Sun Chemical); SPECTRA PAC C Orange 16 (Sun Chemical); HELIOGEN® Blue K6902, K6910 (BASF); SUNFAST® Magenta 122 (Sun Chemical); HELIOGEN® Blue D6840, D7080 (BASF); SUDAN® Blue OS (BASF); NEOPEN Blue FF4012 (BASF); PV Fast Blue B2GO1 (Clariant); IRGALITE Blue GLO (BASF); PALIOGEN® Blue 6470 (BASF); SUDAN® Orange G (Aldrich); SUDAN® Orange 220 (BASF); PALIOGEN® Orange 3040 (BASF); PALIOGEN® Yellow 152, 1560 (BASF); LITHOL® Fast Yellow 0991 K (BASF); PALIOTOL Yellow 1840 (BASF);

NOVOPERM Yellow FGL (Clariant); Ink Jet Yellow 4G VP2532 (Clariant); Toner Yellow HG (Clariant); Lumogen Yellow D0790 (BASF); Suco-Yellow L1250 (BASF); Suco-Yellow D1355 (BASF); Suco Fast Yellow D1355, D1351 (BASF); HOSTAPERM Pink E 02 (Clariant); Hansa Brilliant Yellow 5GX03 (Clariant); Permanent Yellow GRL 02 (Clariant); Permanent Rubine L6B 05 (Clariant); FANAL Pink D4830 (BASF); CINQUASIA® Magenta (DU PONT); PALIOGEN® Black L0084 (BASF); Pigment Black K801 (BASF); and carbon blacks such as REGAL 330™ (Cabot), Nipex 150 (Evonik) Carbon Black 5250 and Carbon Black 5750 (Columbia Chemical), and the like, as well as mixtures thereof.

Pigment dispersions in the CPF toner may be stabilized by synergists and dispersants. Generally, suitable pigments may be organic materials or inorganic. Magnetic material-based pigments are also suitable, for example, for the fabrication of robust Magnetic Ink Character Recognition (MICR) inks. Magnetic pigments include magnetic nanoparticles, such as for example, ferromagnetic nanoparticles.

Also suitable are the colorants disclosed in U.S. Pat. No. 6,472,523, U.S. Pat. No. 6,726,755, U.S. Pat. No. 6,476,219, U.S. Pat. No. 6,576,747, U.S. Pat. No. 6,713,614, U.S. Pat. No. 6,663,703, U.S. Pat. No. 6,755,902, U.S. Pat. No. 6,590,082, U.S. Pat. No. 6,696,552, U.S. Pat. No. 6,576,748, U.S. Pat. No. 6,646,111, U.S. Pat. No. 6,673,139, U.S. Pat. No. 6,958,406, U.S. Pat. No. 6,821,327, U.S. Pat. No. 7,053,227, U.S. Pat. No. 7,381,831 and U.S. Pat. No. 7,427,323, the disclosures of each of which are incorporated herein by reference in their entirety.

In embodiments, solvent dyes are employed. An example of a solvent dye suitable for use herein may include spirit soluble dyes because of their compatibility with the CPF toner carriers disclosed herein. Examples of suitable spirit solvent dyes include NEOZAPON® Red 492 (BASF); ORASOL® Red G (Pylam Products); Direct Brilliant Pink B (Global Colors); Aizen Spilon Red C-BH (Hodogaya Chemical); Kayanol Red 3BL (Nippon Kayaku); Spirit Fast Yellow 3G; Aizen Spilon Yellow C-GNH (Hodogaya Chemical); CARTASOL® Brilliant Yellow 4GF (Clariant); PERGASOL® Yellow 5RA EX (Classic Dyestuffs); ORASOL® Black RLI (BASF); ORASOL® Blue GN (Pylam Products); Savinyl Black RLS (Clariant); MORFAST® Black 101 (Rohm and Haas); THERMOPLAST® Blue 670 (BASF); Savinyl Blue GLS (Sandoz); LUXOL® Fast Blue MBSN (Pylam); Sevron Blue 5GMF (Classic Dyestuffs); BASACID® Blue 750 (BASF); KEYPLAST® Blue (Keystone Aniline Corporation); NEOZAPON® Black X51 (C.I. Solvent Black, C.I. 12195) (BASF); SUDAN® Blue 670 (C.I. 61554) (BASF); SUDAN® Yellow 146 (C.I. 12700) (BASF); SUDAN® Red 462 (C.I. 260501) (BASF), mixtures thereof and the like.

The colorant may be present in the cold pressure fix toner in any desired or effective amount to obtain the desired color or hue such as, for example, at least from about 0.1 percent by weight of the CPF toner to about 50 percent by weight of the CPF toner, at least from about 0.2 percent by weight of the CPF toner to about 20 percent by weight of the CPF toner, and at least from about 0.5 percent by weight of the CPF toner to about 10 percent by weight of the CPF toner. The colorant may be included in the CPF toner in an amount of from, for example, about 0.1 to about 15% by weight of the CPF toner, or from about 0.5 to about 6% by weight of the CPF toner.

The polyester resins and toners described herein are further illustrated in the following examples. All parts and percentages are by weight unless otherwise indicated.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

Example 1

This example describes the general synthesis of rosin acid-based polyester (Sample 1).

A 2-L buchi reactor was charged with 356.8 Foral AX (Rosin Acid, available from Pinova), 166 g of neopentyl glycol diglycidyl ether (available from Sigma-Aldrich), and 0.57 g of tetraethyl ammonium bromide (available from Sigma-Aldrich). The mixture was heated to 175° C. over a three hour period with stirring under nitrogen, and then maintained at 175° C. for five more hours and until the acid value of the resulting rosin-diol (Scheme I supra) was 1.8 mg of KOH/g of resin. To the mixture was then added 306 g propylene glycol (available from Archer-Daniels Midland), 844.5 grams of sebacic acid (available from Sigma-Aldrich) and 2 g of TC400 catalyst (available from Elf-Atochem). The mixture was slowly heated to 195° C. over a six hour period, followed by vacuum distillation until the resin viscosity of 15 and acid value of 13.5 mg of KOH/g of resin was obtained. The resin was then discharged and allowed to cool to room temperature.

Example 2

This example describes a general procedure for toner preparation.

I. Latex Preparation

A latex of 167.9 nm size was prepared by solvent free phase change co-emulsification of a 79/21 ratio of C10/C6 CPE (Poly-1,6-hexylene-dodecanoate) (AV=10.2 mg KOH/g resin) and Sample 1 (AV=13.5 mg KOH/g resin). 158 grams of C10/C6 CPE resin, 42 grams of Sample 1 resin, 10 grams of Tayca (60 wt %, available from Tayca Corporation), and 6.7 grams of triethylamine (available from Sigma-Aldrich) were measured into a 2 liter Buchi glass reactor. Heat the reactor to 100° C. over 10 minutes. Started the agitator to stir the mixture slowly (around 60 rpm) when the reactor temperature was above 65° C. The stirring speed had been increased to 200 rpm when the temperature was above 95° C. and 320 grams of DIW started to be fed into reactor at around 3.5 grams per minutes feeding rate using FMI Lab Pump (Model Q3-20). The reactor was cooled down to 25° C. and the latex was discharged and screened through a 25 micron sieve. The resulting resin emulsion (Sample 1 latex) is comprised of about 37.12 percent by weight solids in water, and has a volume average diameter of about 167.9 nanometers as measured with a HONEYWELL MICROTRAC® UPA150 particle size analyzer.

II. Toner Preparation

Toner a (from Sample 1 Latex)

Into a 2 liter glass reactor equipped with an overhead stirrer was added 29.67 grams of PB15:3 (Pigment Blue 15:3, available from Sun Chemicals) dispersion (16.16 wt %), 19.17 grams of styrene acrylate latex (41.72 wt %) and 160.56 grams of Sample 1 latex. The mixture was evenly mixed, the pH of mixture adjusted to 2.78 and then stirred at 4000 rpm using an IKA Ultra-Turrax homogenizer. 19.20 grams of polyaluminum chloride (available from Inabata America Corporation) solution was added dropwise as flocculent and with continued homogenization. After which the resulting mixture was heated from room temperature to 45° C. at a rate of 1° C. per minutes with stirring at about 250 rpm. The particle size was monitored with a Coulter Counter until the core particles reached a volume average particle size of 5.25 pm. Then, 20.06 grams of styrene acrylate latex (40.67 wt %) was added as shell material, resulting in core-shell structured particles with an average size of 5.77 microns Thereafter, the pH of the reaction slurry was increased to 7.8 using 11.02 grams of EDTA (39 wt %, available from Sigma-Aldrich) and to freeze the toner growth. After freezing, the reaction mixture was heated to 70° C. and the pH of mixture decreased to 5.5 using 84.44 grams of 0.3 M $HNO_3$. Thereafter, the reaction mixture was increased to 75° C. and maintained at this temperature for a total of 90 minutes for coalescence. The toner was quenched and it had a final particle size of 5.77 microns and circularity 0.971. The toner slurry was then cooled to room temperature, separated by sieving (25 μm), filtration, followed by washing and freeze dried.

Toner 2 (from Sample 1 Latex)

Into a 2 liter glass reactor equipped with an overhead stirrer was added 29.67 grams of PB15:3 dispersion (16.16 wt %), 19.17 grams of styrene acrylate latex (41.72 wt %) and 160.56 grams Sample 1 latex. The above mixture was evenly mixed, the pH of mixture adjusted to 2.91 and then stirred at 4000 rpm using an IKA Ultra-Turrax homogenizer. 9.60 grams of polyaluminum chloride solution was added dropwise as flocculent and with continued homogenization. After which the resulting mixture was heated from room temperature to 49° C. at a rate of 1° C. per minutes with stirring at about 220 rpm. The particle size was monitored with a Coulter Counter until the core particles reached a volume average particle size of 4.73 pm. Then, 19.56 grams of styrene acrylate latex (41.72 wt %) was added as shell material, resulting in core-shell structured particles with an average size of 5.83 microns Thereafter, the pH of the reaction slurry was increased to 7.8 using 11.06 grams of EDTA (39 wt %) and to freeze the toner growth. After freezing, the reaction mixture was heated to 70° C. and the pH of mixture decreased to 5.5 using 64.86 grams of 0.3 M $HNO_3$. Thereafter, the reaction mixture was increased to 90° C. and maintained at this temperature for a total of 90 minutes for coalescence. The toner was quenched and it had a final particle size of 7.82 microns and circularity 0.953. The toner slurry was then cooled to room temperature, separated by sieving (25 μm), filtration, followed by washing and freeze dried.

| Toners | Core Resin | Shell Resin | Particle Size | Circularity |
|---|---|---|---|---|
| A | CPE10:6/Sample1 latex/ styrene acrylate[a] | styrene acrylate[b] | 5.77 micron | 0.971 |
| B | CPE10:6/Sample1 latex/ styrene acrylate[a] | styrene acrylate[a] | 7.82 micron | 0.953 |

[a]Latex comprised of 80% by weight of styrene, 18.5% by weight of n-butyl acrylate and 1.5% by weight of beta-carboxyethyl acrylate; the resin displays a $T_g$ of 59.9° C., $M_n$ = 8,949 g/mole and $M_w$ of 24,500 g/mole.
[b]Latex is comprised of 79% by weight of styrene, 18% by weight of n-butyl acrylate and 3.0% by weight of beta-carboxyethyl acrylate; the resin displays a $T_g$ of 63.2° C., $M_n$ = 13,050 g/mole and $M_w$ of 36,562 g/mole.

What is claimed is:

1. A cold pressure fix toner composition comprising:

at least one crystalline polyester having a melting point in a range from about 30° C. to about 130° C.;

a rosin acid-based polyester resin; and an amorphous polyester having a $T_g$ higher than the rosin acid-based polyester, wherein the rosin acid-based polyester resin is formula I:

I

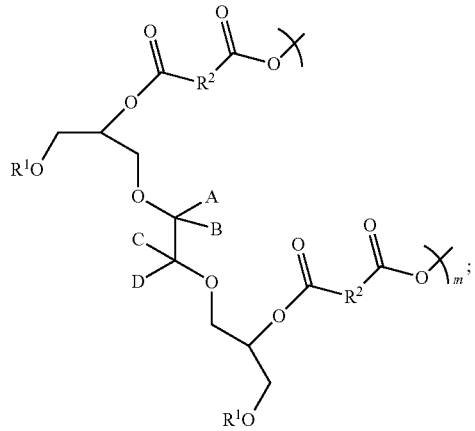

wherein $R^1$ is a rosin acid of a family member of an abietic acid and/or a pimaric acid;

wherein the family member of the abietic acid and/or pimaric acid is selected from the group consisting of dehydro-abietic acid, neo-abietic acid, levo-pimaric acid, pimaric acid, sandaracopimaric acid, iso-pimaric acid and tetrahydro abietic acid;

$R^2$ is $(CH_2)_n$, wherein n is an integer from 2 to 8;

A, B, C, and D are independently hydrogen or methyl; and m is an integer from 10 to 10,000.

2. The cold pressure fix toner composition of claim 1, wherein the at least one crystalline polyester comprises a diester.

3. The cold pressure fix toner composition of claim 1, wherein the number average molecular weight $M_n$ of the crystalline polyester is from about 300 to about 1200, and a weight average molecular weight $M_w$ is from about 300 to about 2,000.

4. The cold pressure fix toner composition of claim 1, wherein the number average molecular weight $M_n$ of the amorphous polyester is from about 3,000 to about 120,000, and the weight average molecular weight $M_w$ is from about 5,000 to about 200,000 grams per mole.

5. The cold pressure fix toner composition of claim 1, wherein the temperature difference between the rosin acid-based polyester resin and the amorphous polyester resin is in a range from about 30° C. to about 110° C.

6. The cold pressure fix toner composition of claim 1, wherein the temperature difference between the rosin acid-based polyester resin and the amorphous polyester resin is in a range from about 20° C. to about 50° C.

7. The cold pressure fix toner composition of claim 1, wherein the rosin acid-based polyester resin has a $T_g$ in a range from about 0° C. to about −45° C.

8. The cold pressure fix toner composition of claim 1, wherein the amorphous polyester resin has a $T_g$ in a range from about 40° C. to about 70° C.

9. A cold pressure fix toner composition comprising:

at least one crystalline polyester having a melting point in a range from about 30° C. to about 130° C.;

a rosin acid-based polyester resin having a $T_g$ in a range from about 0° C. to about −45° C.; and an amorphous polyester having a $T_g$ in a range from about 40° C. to about 70° C.

10. The cold pressure fix toner composition of claim 9, wherein the at least one crystalline polyester comprises a diester.

11. The cold pressure fix toner composition of claim 9, wherein the number average molecular weight $M_n$ of the crystalline polyester is from about 300 to about 1200, and a weight average molecular weight $M_w$ is from about 300 to about 2,000.

12. The cold pressure fix toner composition of claim 9, wherein the rosin acid-based polyester resin is formula I:

I

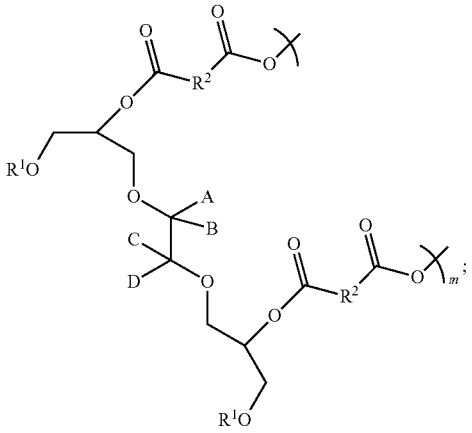

wherein $R^1$ is a rosin acid of an abietic acid, a pimaric acid, or combinations thereof;

$R^2$ is $(CH_2)_n$, wherein n is an integer from 2 to 8;

A, B, C, and D are independently hydrogen or methyl; and m is an integer from 10 to 10,000.

13. The cold pressure fix toner composition of claim 9, wherein the number average molecular weight $M_n$ of the amorphous polyester is from about 300 to about 1200, and the weight average molecular weight Mw is from about 300 to about 2,000.

14. The cold pressure fix toner composition of claim 9, wherein the temperature difference between the rosin acid-based polyester resin and the amorphous polyester resin is in a range from about 20° C. to about 50° C.

15. A cold pressure fix toner composition comprising:

at least one crystalline polyester having a melting point in a range from about 30° C. to about 130° C., wherein the at least one crystalline polyester comprises a diester;

a rosin acid-based polyester resin; and an amorphous polyester having a $T_g$ higher than the rosin acid-based polyester; wherein the temperature difference between the rosin acid-based polyester resin and the amorphous polyester resin is in a range from about 30° C. to about 110° C.

16. The cold pressure fix toner composition of claim 15, wherein the number average molecular weight $M_n$ of the crystalline polyester is from about 300 to about 1200, and a weight average molecular weight $M_w$ is from about 300 to about 2,000.

17. The cold pressure fix toner composition of claim 15, wherein the rosin acid-based polyester resin is formula I:

I

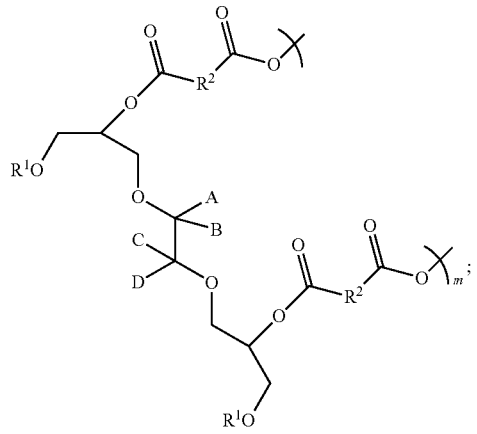

wherein $R^1$ is a rosin acid of a family member of an abietic acid and/or a pimaric acid;

wherein the family member of the abietic acid and/or pimaric acid is selected from the group consisting of dehydro-abietic acid, neo-abietic acid, levo-pimaric acid, pimaric acid, sandaracopimaric acid, iso-pimaric acid and tetrahydro abietic acid;

$R^2$ is $(CH_2)_n$, wherein n is an integer from 2 to 8;

A, B, C, and D are independently hydrogen or methyl; and m is an integer from 10 to 10,000.

* * * * *